US005240298A

United States Patent [19]

Teaby et al.

[11] Patent Number: 5,240,298

[45] Date of Patent: Aug. 31, 1993

[54] LOAD-LIFTING AND ORIENTING APPARATUS

[76] Inventors: Gregory W. Teaby; John E. Teaby, both of 1165 Castro Rd., Monterey, Calif. 93940

[21] Appl. No.: 846,971

[22] Filed: Mar. 6, 1992

Related U.S. Application Data

[63] Continuation of Ser. No. 571,385, Aug. 21, 1990, abandoned.

[51] Int. Cl.[5] ..... B66C 13/08

[52] U.S. Cl. ..... 294/81.4; 294/67.5

[58] Field of Search ..... 294/67.21, 67.5, 74, 294/81.3, 81.4, 81.56, 82.12, 82.13, 86.41; 254/390

[56] References Cited

U.S. PATENT DOCUMENTS

| | | | |
|---|---|---|---|
| 199,955 | 2/1878 | Box | 294/82.12 X |
| 2,020,306 | 11/1935 | Fitch | 294/81.03 |
| 2,124,470 | 7/1938 | Reukaut, Jr. | 254/390 |
| 2,412,488 | 12/1946 | Austin | 294/81.03 |
| 2,596,502 | 5/1952 | Moore | 294/82.12 X |
| 2,617,677 | 11/1952 | Pridy | 294/82.12 X |
| 3,075,664 | 1/1963 | Collings | 294/86.41 X |
| 3,254,913 | 6/1966 | Young | 294/82.12 |
| 3,413,028 | 11/1968 | Wilkie | 294/81.03 |
| 3,433,459 | 3/1969 | Logan | 294/81.3 X |
| 3,532,324 | 10/1970 | Crittenden | 294/81.04 X |
| 3,541,888 | 11/1970 | Hegar et al. | 254/343 X |
| 3,598,440 | 8/1971 | Ramsden | 294/81.03 |
| 3,653,518 | 4/1972 | Polen | 294/81.04 |
| 3,663,051 | 5/1972 | Yu | 294/82.12 X |
| 3,780,877 | 12/1973 | Levitt | 294/81.04 |
| 4,753,322 | 6/1988 | Yasuda | 254/390 X |
| 4,917,361 | 4/1990 | Maxcy | 254/390 X |

FOREIGN PATENT DOCUMENTS

| | | | |
|---|---|---|---|
| 0345105 | 12/1989 | European Pat. Off. | 294/81.03 |
| 7511230 | 5/1976 | Netherlands | 294/81.3 |
| 751779 | 7/1980 | U.S.S.R. | 294/82.12 |
| 796151 | 1/1981 | U.S.S.R. | 294/81.4 |
| 1204539 | 1/1986 | U.S.S.R. | 294/81.4 |
| 1281502 | 2/1987 | U.S.S.R. | 294/81.03 |
| 1344720 | 10/1987 | U.S.S.R. | 294/81.3 |

*Primary Examiner*—Johnny D. Cherry
*Attorney, Agent, or Firm*—Townsend and Townsend Khourie and Crew

[57] ABSTRACT

An improved load-lifting and orienting apparatus in which the load orienting part of the apparatus can be removably and pivotally coupled to the load-lifting part of the apparatus. The load-lifting part includes a boom assembly having a shiftable boom. The load orienting part includes a beam having a capstan around which a single cable is wound. The end portions of the cable extend downwardly from bearing structure at the ends of the beam, whereby the lower ends of the cable can be coupled to a load, such as a telephone pole or vehicle engine. The capstan is rotatable by a hand tool or by a drive motor, whereby the capstan can be rotated in one direction to shorten the length of one cable portion and to lengthen the other cable portion. Rotation of the capstan in the opposite direction lengthens the one cable portion and shortens the other cable portion. The shortening and lengthening of the cable portions allow the load to be shifted about as desired.

2 Claims, 2 Drawing Sheets

LOAD-LIFTING AND ORIENTING APPARATUS

This is a continuation of application Ser. No. 07/571,385, filed Aug. 21, 1990, now abandoned.

This invention relates to improvements in the lifting of loads of various kinds and, more particularly, to apparatus which allows for orienting a load after the load has been lifted above the ground.

BACKGROUND OF THE INVENTION

Load-lifting and orienting devices have been known and used in the past. Generally, these devices are quite complex in construction and operation and are expensive to produce and maintain. Disclosures relating to this general subject matter are found in U.S. Pat. Nos. 2,020,306, 2,412,488 and 3,541,888.

U.S. Pat. No. 2,020,306 shows a load-lifting apparatus having a beam and a pair of sheaves mounted on a rotatable shaft for lifting a load from a vehicle. A pair of cables are connected to the lower of the load and the cables are wound around the sheaves. A motor which drives a worm rotates a worm gear coupled to the shaft. The patent states that when the motor is not operating, the worm will hold the sheaves stationary.

U.S. Pat. No. 2,412,488 shows a load-lifting apparatus including a frame having end blocks so that a screw can be rotated by a crank arm to shift a hoist cage along the length of the frame to equalize a load. Chains are secured to a load, such as a vehicle engine, and a screw is rotated so that the cage is approximately in the center of the frame. The hoist is lifted until the engine is raised a slight distance, and the cage is repositioned along the length of the frame so that the weight of the engine is equalized between the supporting chains.

U.S. Pat. No. 3,541,888 discloses a worm which can be used to prevent uncontrolled reverse rotation of a winch assembly comprised of a winch drum and a rope.

Because of the drawbacks and problems associated with prior load-lifting and orienting structures of conventional design, a need exists for improvements in this type of mechanical equipment and the present invention satisfies this need.

SUMMARY OF THE INVENTION

The present invention provides an improved load-lifting and orienting apparatus in which the load orienting part of the apparatus can be removably and pivotally coupled to the load-lifting part of the apparatus. The load-lifting part of the apparatus includes a boom assembly having a boom which is raised and lowered and which can be connected by a chain and a pivotal connector to the load orienting part of the apparatus. Thus, the load orienting part can be raised and lowered relative to a support surface and the boom assembly which has a carriage which allows the boom to move from place to place over a surface.

The load orienting part of the apparatus includes a beam having a centrally mounted capstan around which a single cable is wound and is in frictional engagement with the outer surface of the capstan. The cable has end portions which extend outwardly from the capstan along the beam to respective ends of the beams and then past and downwardly from bearing structure, such as rotatable idlers, whereby the lower ends of the cable can be coupled to a load, such as a telephone pole or vehicle engine. A power means, such as a gear having a shaft, is coupled to the capstan and is rotatable by a hand tool or by a drive motor, whereby the capstan can be rotated in one direction to shorten the length of one cable portion and to lengthen the other cable portion. Rotation of the capstan in the opposite direction lengthens the one cable portion and shortens the other cable portion. The shortening and lengthening of the cable portions allow the load to be shifted about as desired so as to be able to place the load at a specific location. For instance, it may be desirable to move a telephone pole to a place of use, such as a vertical hole in the ground. The telephone pole is preferably oriented for movement in a generally horizontal position. Thus, the boom assembly can easily carry the telephone pole to a location adjacent to the hole in the ground. The capstan is rotated in the proper direction to move the telephone pole from a horizontal position to an inclined position, whereby the telephone pole can be easily placed in the hole and then moved to an upright position secured in the ground.

Another example of the use of the load orienting part of the present invention is to couple the load orienting part to a vehicle engine, whereby the engine can be tilted for removal from a vehicle past the firewall of the vehicle and then in a horizontal position and moved to a place where the engine is to be worked on. The engine can be returned to the vehicle and inserted in a reverse manner as that described, all of which can be the result of merely rotating the capstan to shorten and lengthen the cable portions as needed to incline the load or to render it horizontal depending upon the required orientation of the load. Thus, the present invention permits unlimited orientation of a heavy load which must be moved from place to place and then changed in its orientation so as to perform a particular function with the load itself.

The primary object of the present invention is to provide a load orienting and lifting apparatus which is suitable for handling loads of various types and which permits the loads to be moved over the ground and to be oriented into horizontal or inclined positions, all of which can be done in a safe manner without risk of personal injury or damage to the load.

Other objects of this invention will become apparent as the following specification progresses, reference being had to the accompanying drawings for an illustration of the invention.

DETAILED DESCRIPTION OF THE DRAWINGS

Figures 2, 3, 4, 4A:
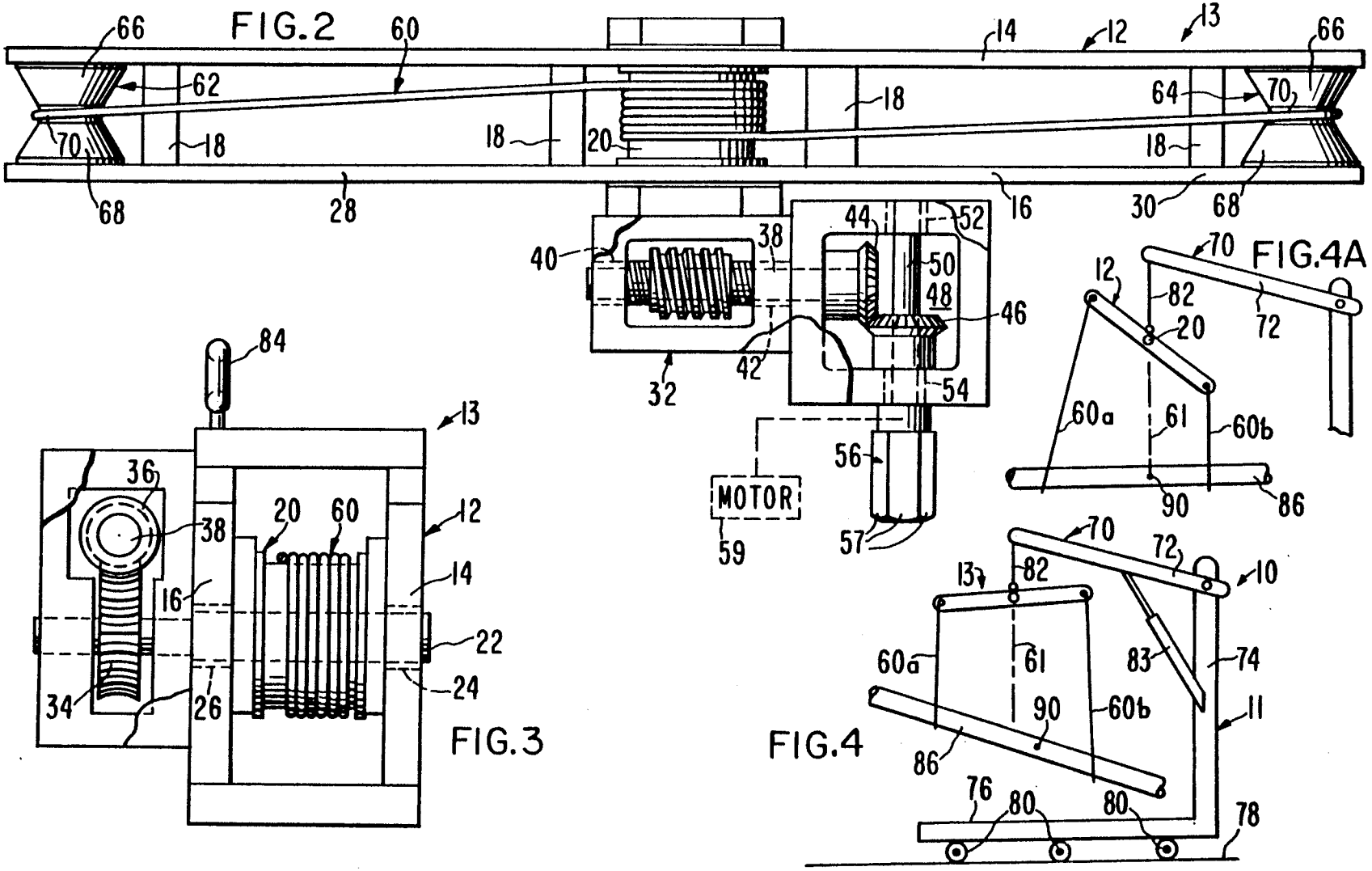
FIG. 2 is a top plan view of the apparatus of FIG. 1.
FIG. 3 is an elevational view, looking from one end of the apparatus.
FIG. 4 is a side elevational view of a boom assembly forming the lifting part of apparatus of the present invention, showing the way in which the load orienting part of the apparatus is coupled to the boom assembly.
FIG. 4A is a view similar to FIG. 4 but showing the load in a horizontal position.

The load-lifting and orienting apparatus of the present invention is broadly denoted by the numeral 10 and includes a load-lifting part 11 and a load orienting part 13, parts 11 and 13 being shown coupled together in FIG. 4. Apparatus 10 is adapted to lift and orient loads of different types, such as telephone poles and vehicle engines.

Load orienting part 13 includes a beam 12 comprised of a pair of beam members 14 and 16 which are spaced apart and interconnected by bridging elements 18 as shown in FIG. 2. The beam is made of a suitable, rigid material, such as hardened steel and the length of the beam can be any suitable value, such as two to four feet or greater.

A capstan or pulley 20 is rotatably mounted by shaft 22 on beam 12 for rotation about the central axis of the shaft 22 relative to the beam 12. The shaft is journalled on beam members 14 and 16 by suitable bearings 24 and 26, respectively. The capstan 20 typically is centrally located midway between the ends 28 and 30 of beam 12 so that the capstan can rotate in opposed directions relative to the beam about the central axis of shaft 22.

A gear box 32 is secured to one side of beam member 16 as shown in FIGS. 2 and 3. Gear box 32 contains a worm gear 34 rigid to shaft 22 for rotation therewith. A worm 36 is in mesh with worm gear 34 as shown in FIG. 3 and is mounted on a shaft 38 which is journalled by bearings 40 and 42 on gear box 32 in any suitable manner. Shaft 38 extends into another section of the gear box as shown in FIG. 2 and is secured rigidly to a bevel gear 44, which in turn is in mesh with a second bevel gear 46 in space 48. Bevel gear 46 is rotatably mounted on a shaft 50 journalled by bearings 52 and 54 on gear box 32 in any suitable manner. Worm gear 34 and worm 36 form structure for releasably holding the capstan against rotation when a shaft 50 is at rest. Thus, the worm gear and worm releasably hold another shaft 38 against rotation when shaft 50 is at rest and allows rotation of shaft 38 when shaft 50 is rotated. The shaft 50 is secured to a tool receiving attachment or fitting 56 having flats 57 by means of which a hand tool (not shown) can be used to manually rotate shaft 50 which, in turn, rotates shaft 38 and shaft 22 to thereby rotate capstan 20 relative to a beam 12. Rotation of shaft 50 can be in either direction to thereby control the direction of rotation of capstan 20. Instead of a hand tool for rotating shaft 50, a reversible motor can be used. The motor can be remotely controlled and can be an electric motor, a pneumatic motor or a hydraulic motor.

A single, flexible cable 60 is wrapped a number of convolutions around and is in frictional engagement with capstan 20 as shown in FIGS. 2 and 3. The cable extends outwardly from the capstan in opposed directions and then about respective idlers 62 and 64 at respective ends 28 and 30 of beam 12. Each idler 62 and 64 has a pair of conical side surfaces 66 and 68 and an annular groove 70 at the center of the idler. The purpose of surfaces 66 and 68 and groove 70 is to assure that the cable portion extending partially about the idler will substantially always be in the center of the idler to avoid frictional engagement with the adjacent portions of the beam.

Load orienting part 13 can be used with any conventional lifting part 11 such as a boom on the bed of a truck or a movable boom assembly of the type shown in FIG. 4. Boom assembly 70 includes a boom 72 pivotally mounted on an upright post 74 mounted on a carriage 76 movable over the surface 78 by means of wheels 80. A fluid-actuated power device 83 couples boom 72 with the post 74 to raise and lower the boom 72 with respect to the surface 78. The outer end of boom 72 has a cable 82 which can be secured in any suitable manner, such as by a ring 84, to beam 12 of apparatus 10. Thus, the boom assembly 70 can be used to raise and lower a load 86, such as a telephone pole, after the lower ends of the cable 60 have been coupled to the load 86.

In use, the lower ends of cable 60 will be coupled in some suitable manner to load 86, such as a telephone pole, and the load will be elevated to some degree by raising boom 72 relative to post 74 by the actuation of power device 83. The ends of the cable will be coupled with the load somewhere near the center thereof, on opposite sides of the center of gravity 90 of the load. In the case of a telephone pole, one end of the pole will typically engage the ground while the other end will be spaced above the ground.

When it is desired to move load 86 over surface 78 to a new location, it is generally desirable that the load be horizontal with respect to the surface. This will entail the rotation of capstan 20 until the center of gravity 90 is substantially vertically aligned with capstan 20. When so vertically aligned, load 86 will be substantially horizontal, and boom assembly 70 can be moved over surface 78 to a new location.

To place load 86 of FIG. 4 in a horizontal position, a crank or other hand tool is connected to fitting 56 (FIG. 2) and shaft 50 is rotated to, in turn, rotate shafts 38 and 22. This action will cause capstan 20 to rotate in a counterclockwise sense when viewing FIG. 4 which will pull up and shorten the cable portion **60*b* (FIG. 4). Simultaneously, this will cause cable portion 60*a* to pay out from the capstan and lengthen. As this occurs, beam 12 becomes more inclined as shown in FIG. 4A and cable portion 60*b* will move closer to a vertical center line 61 through capstan 20. This will cause the center of gravity 90 of load 86 to shift to the left when viewing FIG. 4 until the center of gravity is substantially vertically aligned with capstan 20. As cable portion 60*b* gets shorter, cable portion 60*a* gets longer, and this longer length of cable portion 60*a* allows the load 86 to move to the left when viewing FIG. 4, thus permitting the center of gravity to move also to the left and to become generally vertically aligned with the capstan. When this occurs, the load will be generally horizontal; thus, it will be suitable for movement over surface 78 by moving boom assembly 70** over the surface.

At the destination where the load is to be used, such as a vertical hole for receiving the telephone pole, the end of the load 86 is placed adjacent to the hole, and the capstan is rotated in a clockwise sense, causing cable portion **60*a* to shorten and cable portion 60*b* to lengthen. This causes the load 86 to become inclined again. The angle of the load can thus be made great enough so that the load can easily be dropped into the hole by manipulating the capstan while the cable ends are attached to the load on either side of the center of gravity 90 of the load. The orientation of the load 86 relative to the surface 78** can be changed by merely rotating the capstan.

Figure 1:
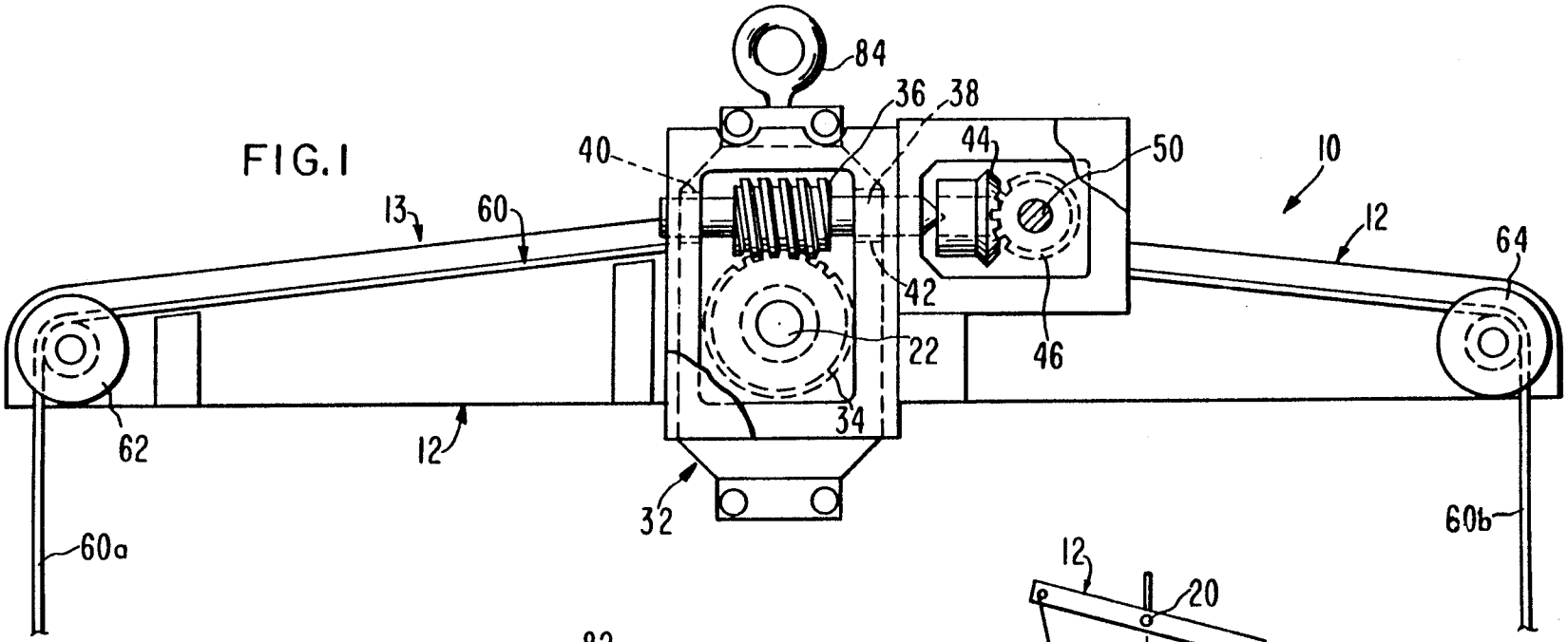
FIG. 1 is a side elevational view of the load orienting part of the load-lifting and orienting apparatus of the present invention.
Figure 6:
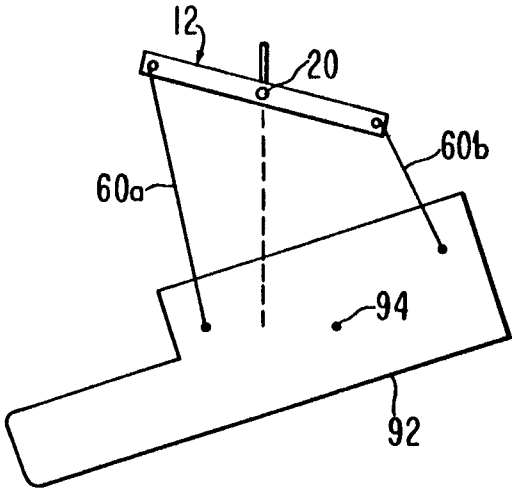
FIG. 6 is a view similar to FIG. 5 but showing the engine in a tilted position for movement beneath the firewall of the vehicle.
Figure 5:
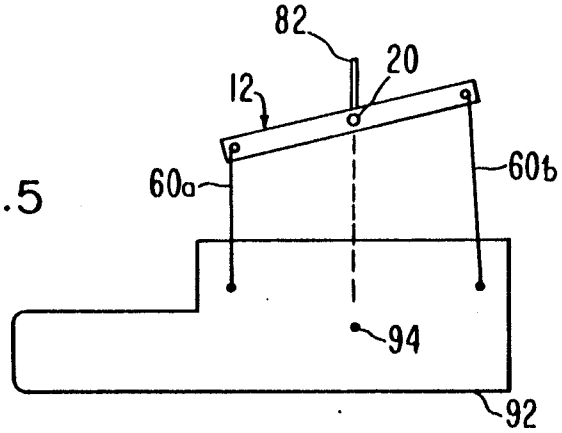
FIG. 5 is a view similar to FIG. 4 but showing the way in which a vehicle engine can be oriented for placement into or movement out of the engine compartment of a vehicle.

FIGS. 5 and 6 show a different type of load, such as an engine 92 of a vehicle, which is to be placed into or taken out of the engine compartment of the vehicle. The engine must be tilted to move it beneath and past the firewall of the vehicle, yet it must be arranged horizontally to properly seat the engine in the vehicle. FIG. 5 shows the way in which the engine is arranged generally horizontally to permit the engine to be moved to the vehicle by boom assembly 70 from a distant location. When the engine is generally horizontal as shown in FIG. 5, the center of gravity 94 is substantially vertically aligned with capstan 20 and cable portions 60*a* and 60*b* are relatively short and relatively long, respectively. FIG. 6 shows the angle of the engine when it is to be moved into or out of the vehicle beneath and past the firewall of the vehicle.

I claim:

1. In a load-lifting and orienting apparatus:

a beam having a pair of opposed ends and adapted to be supported above a surface over which a load is to be positioned and oriented;

a single capstan rotatably mounted on the beam at a location between the ends thereof;

means on the beam near the capstan for attaching the beam to a lifting device;

rotatable bearing idlers on the beam at respective ends thereof;

a single cable having a pair of ends, said cable being wrapped in the form of a spiral around the capstan a number of times and being in frictional engagement therewith, said cable extending outwardly from the capstan, and being freely movable along the beam and partially about and downwardly from the respective bearing idler, whereby a load can be coupled with the cable at the ends of the cable below the beam; and rotatable shaft means coupled with the capstan for rotating the capstan in either of opposed directions relative to the beam when the shaft means is rotated, there being worm means for releasably holding the capstan against rotation in either direction when said shaft means is at rest.

2. A load-lifting and orienting apparatus comprising a beam having a pair of opposed ends;

a single capstan having a first shaft rotatably mounted on said beam between the ends thereof;

means on the beam near the capstan for attaching the beam to a lifting device;

a pair of idlers rotatably mounted on the beam at respective ends thereof;

a flexible cable having a pair of ends, the cable being wrapped a number of times in the form of a spiral around the capstan and being in frictional engagement with the capstan, whereby one end of the cable will pay out from one end of the beam as the capstan rotates in one direction relative to the beam and the opposite end of the cable will pay out from the other end of the beam as the capstan rotates in the opposite direction relative to said beam, said cable extending outwardly from opposite sides of the capstan, and being freely movable along the beam and partially about and downwardly from the idlers, whereby the ends of the cable can be coupled to a load below the beam;

a second shaft; and means coupled with the second shaft for rotating the second shaft abut an axis generally perpendicular to the axis of rotation of the first shaft, said rotating means being operable to rotate the second shaft in opposed directions relative to the beam, and worm gear means coupling the first and second shafts together, said gear means being operable to normally releasably hold the first shaft against rotation in either direction when the second shaft is at rest and to allow rotation of the first shaft when the second shaft is rotated.

* * * * *